US006896502B1

(12) United States Patent
Patterson

(10) Patent No.: US 6,896,502 B1
(45) Date of Patent: May 24, 2005

(54) FLUID CANNON POSITIVE DISPLACEMENT PUMP

(75) Inventor: Albert W. Patterson, West Lorne (CA)

(73) Assignee: 1564330 Ontario Inc., Seaforth (CA)

( * ) Notice: Subject to any disclaimer, the term of this patent is extended or adjusted under 35 U.S.C. 154(b) by 0 days.

(21) Appl. No.: 10/887,358

(22) Filed: Jul. 9, 2004

(51) Int. Cl.[7] ..... F01C 1/00

(52) U.S. Cl. ..... 418/260; 418/159; 418/259; 418/266; 418/268

(58) Field of Search ..... 418/259, 260, 418/266, 267, 268, 159, 132, 133

(56) References Cited

U.S. PATENT DOCUMENTS

| | | | | |
|---|---|---|---|---|
| 4,551,896 | A * | 11/1985 | Sakamaki et al. | 29/888.025 |
| 6,439,868 | B1 * | 8/2002 | Tomoiu | 418/259 |
| 6,554,596 | B1 | 4/2003 | Patterson et al. | |
| 6,799,549 | B1 * | 10/2004 | Patterson et al. | 418/268 |

FOREIGN PATENT DOCUMENTS

| | | | | |
|---|---|---|---|---|
| CA | 202 671 | | 3/1920 | |
| GB | 166871 | * | 1/1992 | 418 267 |
| JP | 61241482 A | * | 10/1986 | F04C 18/344 |

OTHER PUBLICATIONS

U.S. Appl. No. 10/680,236, filed Oct. 8, 2003, A. W. Patterson, Inventor.
Printouts from the website of Thomas Industries featuring rotary pumps.

* cited by examiner

*Primary Examiner*—Theresa Trieu
(74) *Attorney, Agent, or Firm*—Nixon Peabody LLP; Jeffrey L. Costellia

(57) ABSTRACT

A positive displacement pump comprising a casing having an interior chamber and an inlet and an outlet oppositely spaced within the chamber. A rotor with a cylindrical outer surface is secured in offset position within the chamber. An end disk is secured to each end of the rotor. Three planar vanes are provided, each having sides and inner and outer edges. The sides of the vanes are seated within the end disk slots. The outer edges of the vanes are in constant contact with the side wall of the chamber. The inner edges of the vanes are constantly movably seated in the rotor slots during operation of the pump. The slots in the rotor within which the vanes are seated are formed along a chord when the rotor is viewed in lateral cross section and are orientated so that their planes lie at 60° angles to the planes of adjacent slots.

8 Claims, 6 Drawing Sheets

FLUID CANNON POSITIVE DISPLACEMENT PUMP

FIELD OF THE INVENTION

The present invention relates to the novel construction of positive displacement pump for fluids, and more particularly to a rotary piston pump.

BACKGROUND OF THE INVENTION

Rotary pistons, in the nature of encased, eccentrically positioned rotors with radially extending vanes which move in and out of the rotors, depending upon their position on the rotational cycle of the rotor, used, for example as pumps or turbines, are known. One such device is described in U.S. Pat. No. 6,554,596 of Albert and David Patterson issued Apr. 29, 2003, in which the vane movement, in and out of the rotor, is achieved by cam surfaces within the casing which act on both inner and outer edges of the vanes.

In my co-pending U.S. patent application Ser. No. 10/680,236 entitled "Rotary Pistons", the outward movement of the vanes is achieved by upward extensions of shoulders at the sides of each vane, which upward extensions contain pins which are seated in races continuously extending in portions of the interior wall of the casing and positioned so that as the pins move about the races, they draw their respective vanes outwardly.

Other known constructions of such vane pumps require centrifugal force, through rotation of the rotor, to force the vanes out.

Thomas Industries currently markets a rotary piston pump of the type in question, where the vanes do not move radially but instead move at angles to each other within shallow slots, each slot having a depth of less than half the diameter of the cross section of the rotor body, each vane being supported by the walls of the corresponding slot during operation of the rotor. As the slots are the support for the vanes, the vanes are permitted to extend out of the slots only a limited degree, reducing the volume of fluid that can be pumped at one time. As well, the vanes can handle only limited pressure. This pump is particularly well suited for propulsion of jet ski water craft.

Traditionally, positive displacement pumps have been of relatively complex construction and have been limited in their applications.

It is an object of the present invention to provide a positive displacement pump which is relatively economical to construct and efficient in its operation, which will be able to withstand high pressures, and which will be able to pump relatively high volumes of fluid.

SUMMARY OF THE INVENTION

In accordance with the present invention, there is provided a positive displacement pump comprising a casing having an interior chamber and an inlet and an outlet oppositely spaced within the chamber and communicating therewith. The chamber has a side wall of predetermined shape extending between end walls. A rotor with a cylindrical outer surface is secured in offset position within the chamber so that the rotor outer surface is adjacent the chamber side wall at a point centrally positioned between the inlet and outlet, so as to rotate about an axis extending between the end walls. An end disk is secured to each end of the rotor. The end disks extending beyond the cylindrical outer surface of the rotor and the chamber side wall. Three planar vanes are provided, each having sides and inner and outer edges. Each vane slides and moves outwardly and inwardly within slots in the rotor and end disks, between an extended position and a retracted position. The sides of the vanes are seated within the end disk slots. The outer edges of the vanes are in constant contact with the side wall of the chamber. The inner edges of the vanes are constantly movably seated in the rotor slots during operation of the pump, and outward movement of the vanes is caused by centrifugal force. Inward movement of the vanes is caused by a cam action of the side wall of the chamber bearing on outer edges of the vanes. The slots in the rotor within which the vanes are seated are formed in chord-like fashion when the rotor is viewed in lateral cross section, through sections of the vanes and are orientated so that their planes lie at 60° angles to the planes of adjacent slots.

In one embodiment of the invention, the casing chamber is cylindrical. In another embodiment, a portion of the side wall of the casing chamber is planar and aligned on either side of the centrally positioned point between the inlet and outlet where the rotor cylindrical outer surface is adjacent to that wall and wherein the remainder of the side wall, on either side of the planar portion, extends in regular curved fashion with progressively decreasing radius to a curved portion of constant radius extending between the inlet and outlet, this constant radius portion of the side wall being located at a constant distance from corresponding confronting portions of the cylindrical outer surface of the rotor.

In yet a further embodiment of the present invention, the thickness of the vanes is progressively and uniformly increased between their inner and outer edges, the rotor slots being similarly wider from bottom to top operatively to receive the vanes and allow fluid to escape from the slots when the vanes are moving to retracted position.

The pump according to the present invention permits greater vane surface area to act on fluids within the chamber, providing higher handling rates for fluid volumes. As well, since the vanes are supported at each end by the rotor disks, a non-binding action of the vanes is achieved along with the ability of the vanes to withstand higher fluid pressures during operation.

BRIEF DESCRIPTION OF THE DRAWINGS

These and other advantages of the invention will become apparent upon reading the following detailed description and upon referring to the drawings in which.

Figure 1:
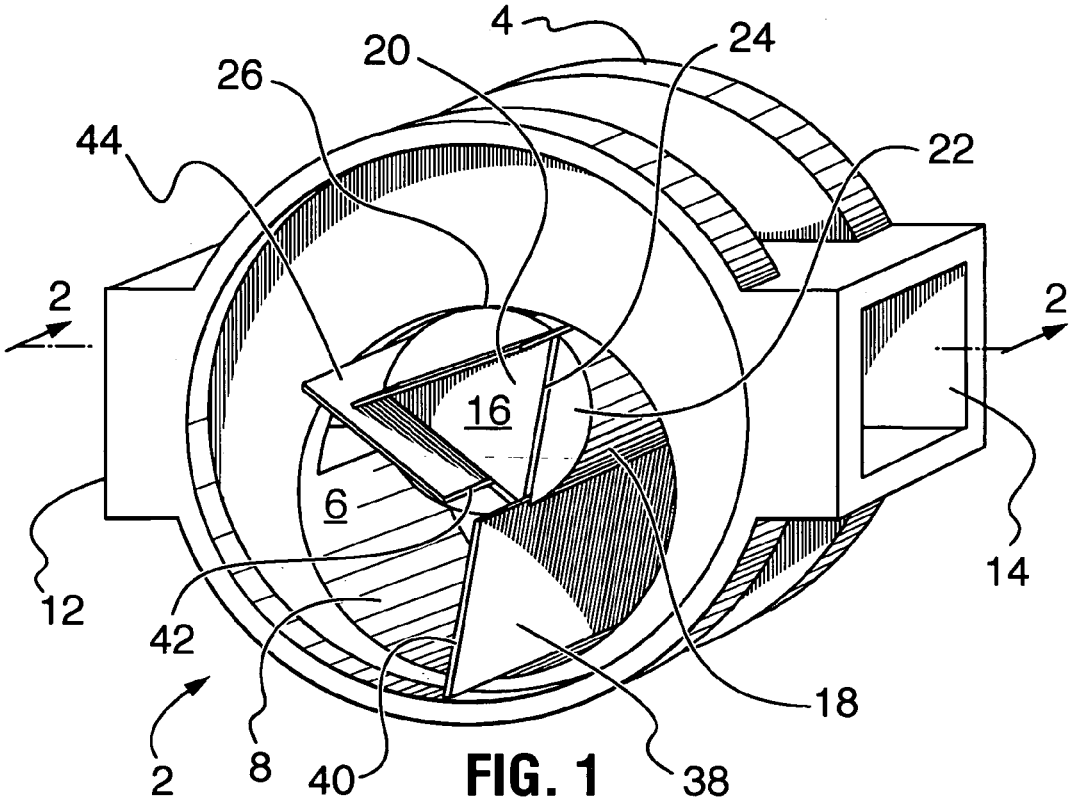
FIG. 1 is a perspective view of a positive displacement pump in accordance with the present invention, with an end disk and part of the chamber wall removed to show details of the rotor, vanes and chambers.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2:
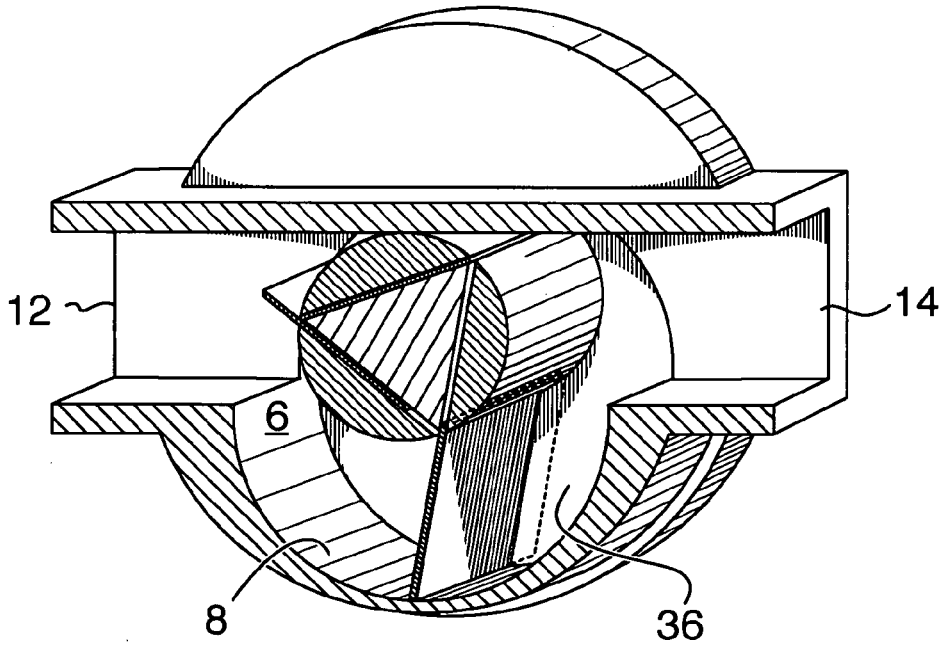
FIG. 2 is a section view of the pump of FIG. 1 along line 2—2.
Figure 3A:
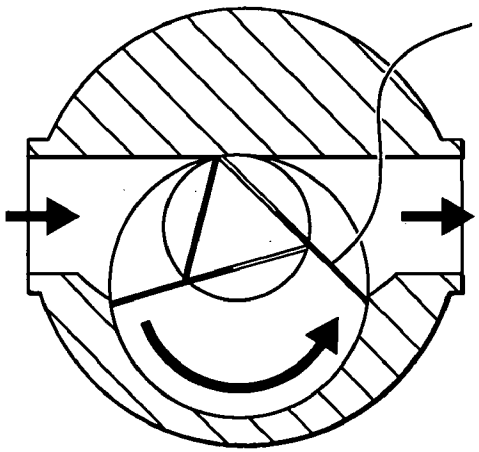
FIGS. 3*a*, 3*b*, 3*c*, 3*d* and 3*e* are schematic section views of the pump of FIGS. 1 and 2, showing the rotor and vanes at progressive stages of operation during a counter clockwise rotor motion.
Figure 3B:
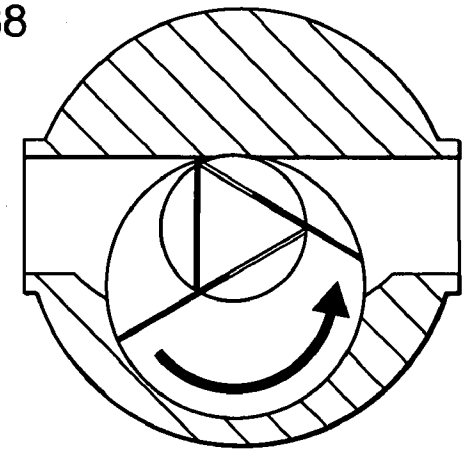
Figure 3C:
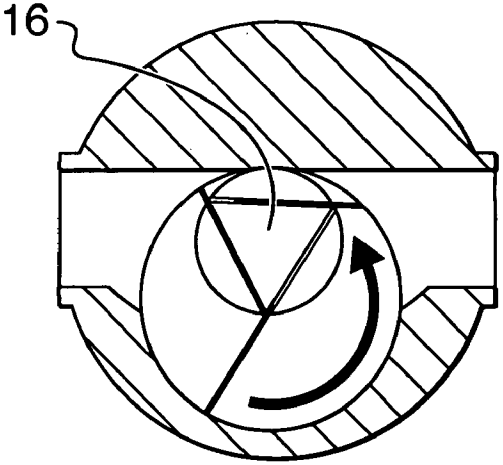
Figure 3D:
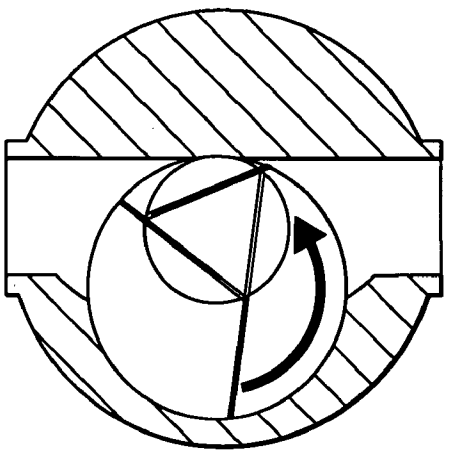
Figure 3E:
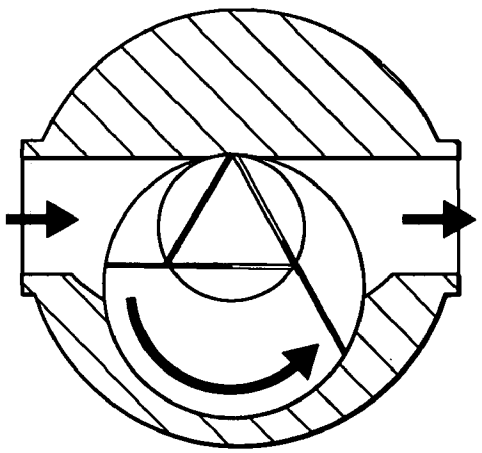

Turning to FIGS. 1 and 2, there is illustrated a positive displacement pump 2 in accordance with the present invention, having a casing 4 with an interior chamber 6 having a side wall 8 and end walls (one of which has been removed on the near side of FIG. 1). An inlet 12 and an outlet 14 are oppositely spaced on casing 4 as illustrated, and communicate with chamber 8.

The side wall of chamber 8 may be cylindrical, with a circular bore, as illustrated in FIGS. 1 to 3, or may have an alternative shape such as the generally kidney shape of FIGS. 6 and 7, more details of which will be set out subsequently.

A rotor 16 is provided with a cylindrical outer surface 18, the rotor being driven by an appropriate drive means (not illustrated). In the illustrated embodiment of FIG. 1 to 3, rotor 16 comprises a triangular core 20 (of equilateral triangular cross section) with similar portions 22 with flat and circularly curved surfaces as illustrated secured in spaced fashion above the triangular surfaces of core 20, to provide planar slots 24 and the cylindrical outer surface 18. These slots are oriented along a chord so that their planes are at 60° angles to the planes of adjacent slots. Rotor 16 is offset, with respect to the chamber side wall 8, as illustrated so that its surface 18 is adjacent side wall 8 at point 26 located between the inlet 12 and outlet 14. The pump configuration of FIGS. 1 and 2 is primarily intended for counter clockwise rotation.

Figure 7:
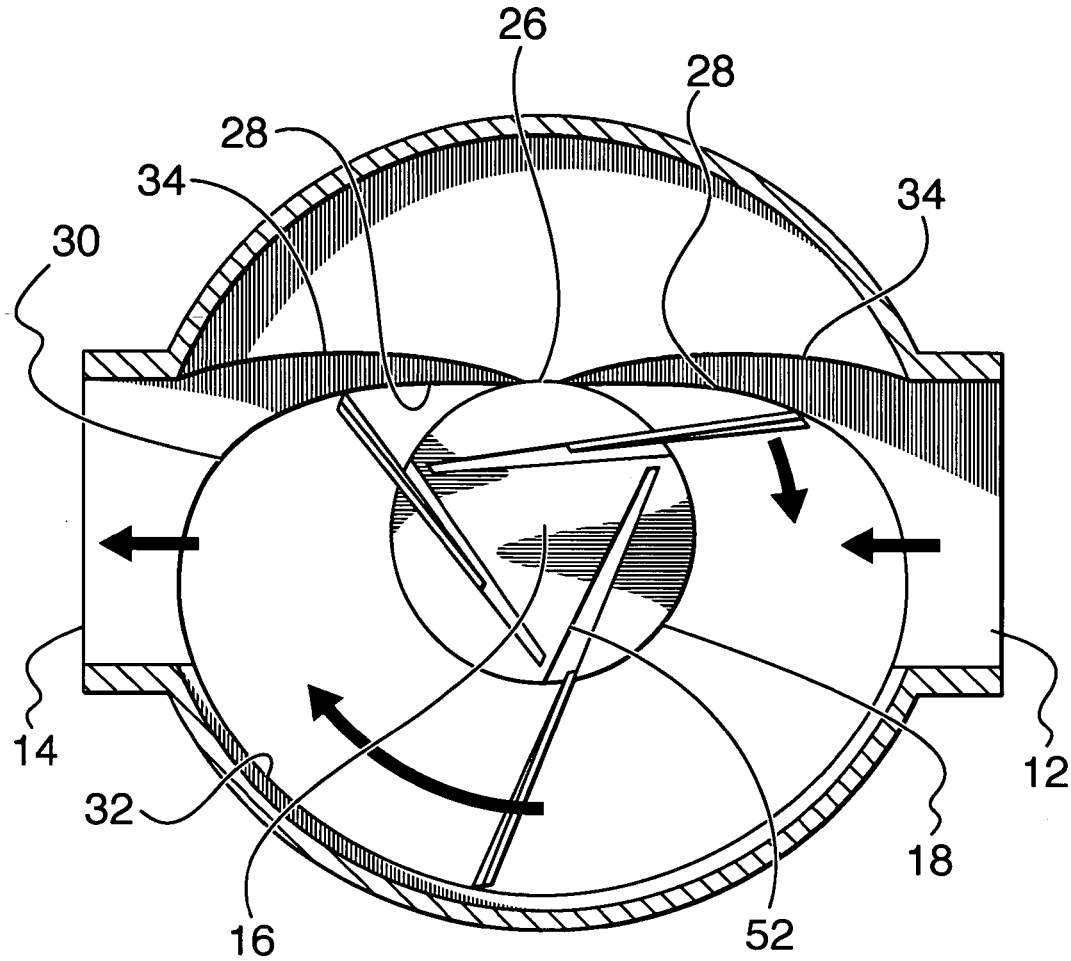
FIG. 7 is a schematic side view of the pump of FIG. 6, in section, illustrating its operation.

With respect to the kidney-shaped bore of chamber 6 illustrated in FIG. 7, a portion 28 of side wall 8 of chamber 6 is planar and aligned, on either side of centrally positioned point 26 between inlet 12 and outlet 14, and that portion extends through curved portion 30, with progressively decreasing radius, to a curved portion 32 of constant radius, portion 32 extending through about 180° of the side wall 8, when viewed in section (FIG. 7). This portion 32 of side wall 8 is located at a constant distance from corresponding confronting portions of the outer surface 18 of rotor 16. As can be seen in FIG. 7, the portions 34 of chamber side wall 8, where it communicates respectively with inlet 12 and outlet 14, are enlarged. This feature ensures that fluid is not trapped within the chamber during operation of the pump.

Figure 4:
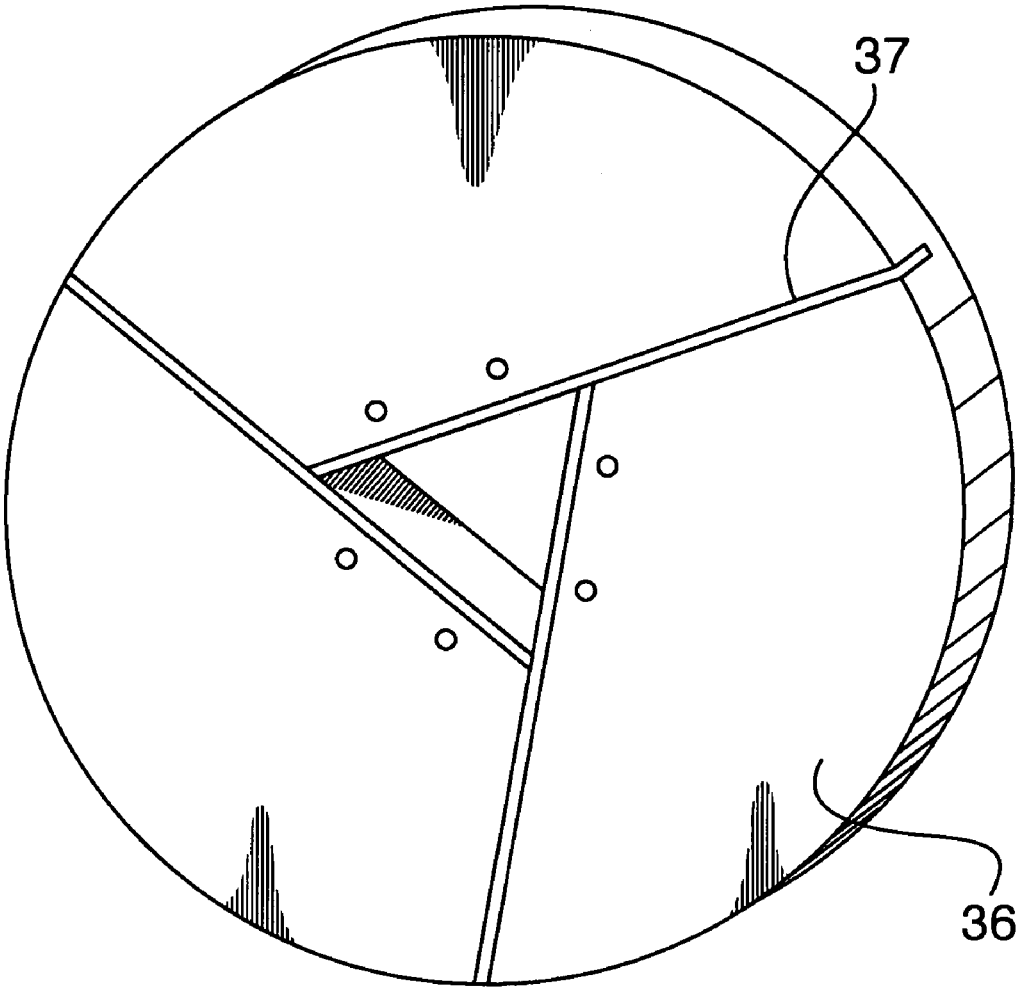
FIG. 4 is a perspective view of an end disk in accordance with the present invention.

Each end of rotor 16 is secured to end disks 36 (FIG. 4). These end disks extend beyond outer surface 18 of rotor 16 and the chamber side wall 8. They have slots 37 aligned with, but extending beyond corresponding slots 24 of rotor 16, towards the peripheries of disks 36. Portions 22 of rotor 16 are secured in spaced relationship to core 20, at their opposite ends, by these end disks 36.

Within slots 24 are movably seated three planar vanes 38 having sides 40, inner edges 42 and outer edges 44. In the embodiment illustrated in FIGS. 1 and 2, these vanes are of a flat planar shape and extend laterally across rotor 16, from end to end, with their sides 40 seated within slots 37 of rotor disks 36. During operation of the pump, each vane 38 slides outwardly and inwardly within rotor slots 24 and end disk slots 37, between respectively an extended position and a retracted position, each of these positions being visible for different vanes in FIG. 1. Outer edges 44 of the vanes are in constant contact with the side wall 8 of the chamber, and at all times the inner edges 42 of the vanes are movably seated in rotor slots 24. This provides tremendous support for vanes 38 during operation of the device, and it enables the vanes to extend to almost their full surface area, beyond slot 24, to permit greater fluid movement by pump 2, while at the same time enabling the vanes to withstand significantly greater fluid pressures then otherwise would be the case if the vane sides 40 were not supported in such end disk slots 37.

During operation, outward movement of the vanes towards extended position is caused by centrifugal force and inward movement of the vanes is caused by a cam action of the side wall 8 of the chamber bearing on outer edges 44 of the vanes. Because of the relative orientation of the slots and blades with respect to the side wall 8 of chamber 6 and surface 18 of rotor 16, the vane 38 act as scoops or sweeps to force fluid from inlet 12 through chamber 6, to outlet 14.

FIGS. 3*a*, 3*b*, 3*c*, 3*d* and 3*e* illustrate the progressive stages of movement of rotor 16, in moving in a counter clockwise (sweeping) motion for a rotational cycle of rotor 16.

Figure 5:
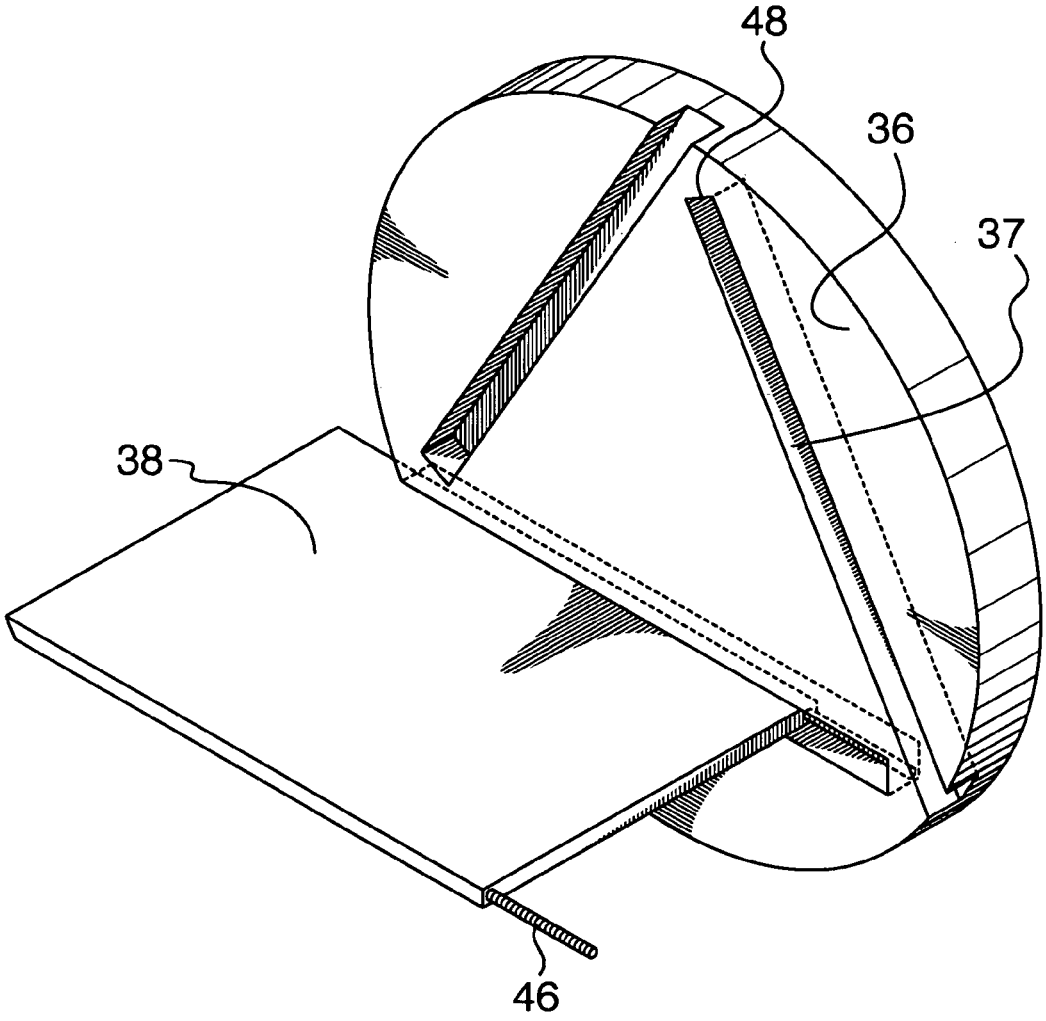
FIG. 5 is a schematic view of an alternative embodiment of an end disk and vane arrangement for the pump according to the present invention.

In FIG. 5, an alternative construction of end disk 36 and vane 38 is illustrated, in this case, the vanes are provided with bias means, illustrated as springs 46, which react with bottoms 48 formed within end disk slots 37. In this manner, outward movement of the vanes, particularly as they commence outward movement from their retracted position, is provided, to complement the effects of centrifugal force. This embodiment permits lower rpm applications of the pump, where centrifugal force may be not adequate to start the outward movement of the blades towards extended position.

Figure 6:
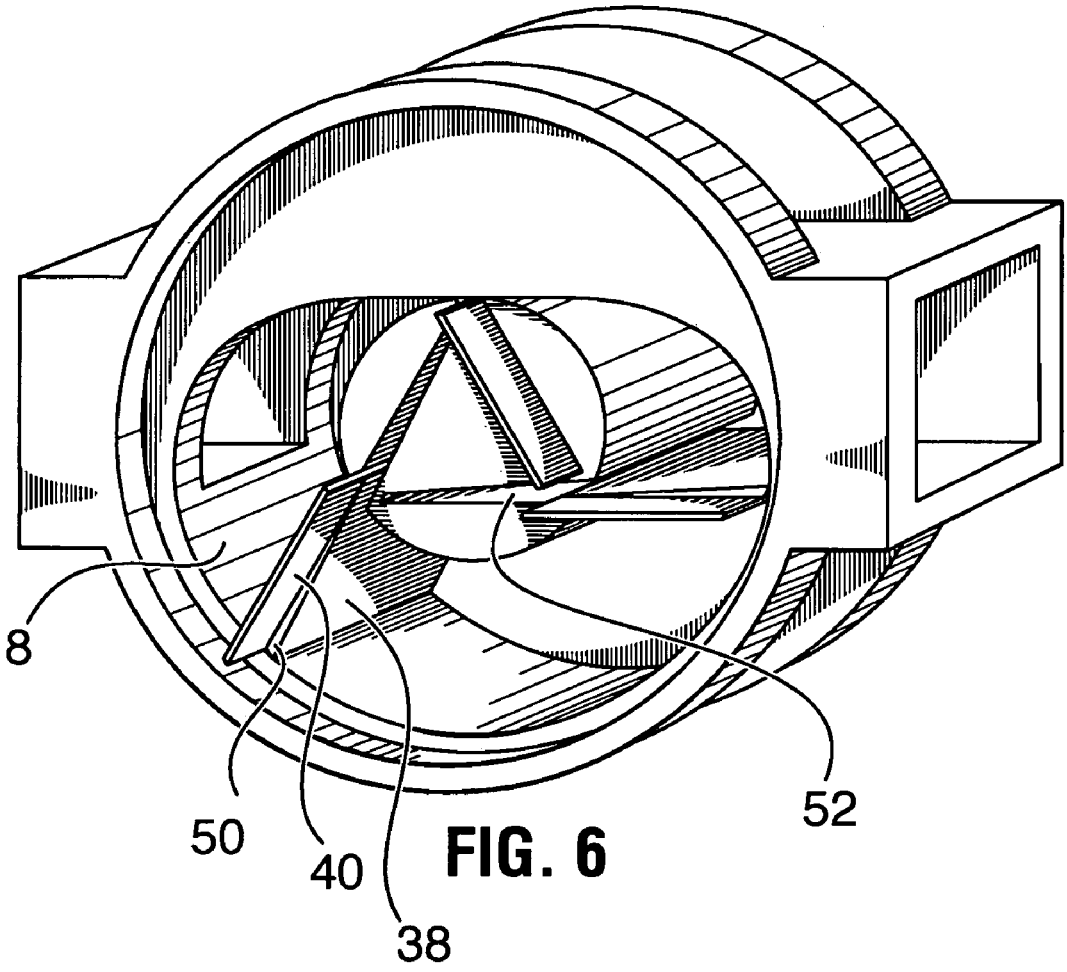
FIG. 6 is a perspective view of an alternative embodiment of pump according to the present invention, with an end disk and part of the chamber wall removed to show details of the rotor, vanes and chambers.

Yet an alternative construction of vane 38 is illustrated in FIGS. 6 and 7, which vanes are illustrated in the kidney-shaped bore of chamber 6 illustrated in the casing of FIGS. 6 and 7, but which vane construction will work equally well in the circular bore of the chamber 6 of FIGS. 1 to 3, where the vanes 38 are provided with a slight outward taper or flare 50 towards their outer edges 44. Sides 40 do not have this outward flare so that end disk slots 37 which slidably receive sides 40, do not have to be modified. Rotor slots 24 however, have a corresponding outward taper or flare 52. With this embodiment, the outward flare of the vanes 38 provides additional weighting along and towards the outer edges 44 of vanes 38, assisting in the movement of the vanes outwardly, under centrifugal force, and allowing higher rpm's on the rotor. As well, the outward flare of slots 24 allows fluid to escape from the slots when the corresponding vanes are moving to retracted position. This embodiment can enable movement of the vanes out of the pockets without the use of springs, and is designed primarily for clockwise rotation of the rotor.

It is seen by the phantom arrows in FIGS. 3*a* through 3*e* and FIG. 7, that the pump will operate as well with a reversed (clockwise) rotation of rotor 16, so that the vanes 38 have more of a scooping, as opposed to a sweeping, action on the fluid, and the inlet and outlet ports are reversed. Clockwise motion of the rotor 16, giving the scooping action, is more applicable for lower rpm's and thicker fluids; counter clockwise, sweeping rotation of rotor 16 is better suited to high rpm and thinner fluids.

Thus, it is apparent that there has been provided in accordance with the invention a rotary piston pump that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention is:

1. A positive displacement pump comprising:

(a) a casing having an interior chamber and an inlet and an outlet oppositely spaced within the chamber and communicating therewith; the chamber having a side wall of predetermined shape extending between end walls;

(b) a rotor with a cylindrical outer surface, the rotor secured in offset position within the chamber so that the rotor cylindrical outer surface is adjacent the chamber side wall at a point centrally positioned between the inlet and outlet, so as to rotate about an axis extending between the end walls;

(c) an end disk secured to each end of the rotor the end disks extending beyond the cylindrical outer surface of the rotor and the chamber side wall; and (d) three planar vanes, having sides and inner and outer edges, each vane slidably movable outwardly and inwardly within slots in the rotor and end disks, between extended position and retracted position, sides of the vanes seated within the end disk slots and outer edges of the vanes being in constant contact with the side wall of the chamber, inner edges of the vanes constantly movably seated in the rotor slots during operation of the pump, and outward movement of the vanes being caused by centrifugal force, inward movement of the vanes being caused by a cam action of the side wall of the chamber bearing on outer edges of the vanes, the slots in the rotor within which the vanes are seated are formed along a chord when the rotor is viewed in lateral cross section, through sections of the vanes and are orientated so that their planes lie at 60° angles to the planes of adjacent slots.

2. A pump according to claim 1, wherein the side wall of the casing chamber is cylindrical.

3. A pump according to claim 1, wherein a portion of the side wall of the casing chamber is planar and aligned on either side of the centrally positioned point between the inlet and outlet where the rotor cylindrical outer surface is adjacent to that wall and wherein the remainder of the side wall, on either side of the planar portion, extends in regular curved fashion with progressively decreasing radius to a curved portion of constant radius extending between the inlet and outlet, this constant radius portion of the side wall being located at a constant distance from corresponding confronting portions of the cylindrical outer surface of the rotor.

4. A pump according to claim 3, wherein the thickness of the vanes is progressively and uniformly increased between their inner and outer edges, the rotor slots being similarly wide from bottom to top operatively to receive the vanes.

5. A pump according to claim 1, wherein the vanes are provided with bias means for assisting the outward movement of the vanes during operation.

6. A pump according to claim 5, wherein the bias means are springs which bear against bottoms of corresponding slots within which the vanes are seated to assist the outward movement of the vanes away from their retracted position during operation.

7. A pump according to claim 1, wherein the thickness of the vanes is progressively and uniformly increased between their inner and outer edges, the rotor slots being similarly wider from bottom to top operatively to receive the vanes and allow fluid to escape from the slots when the vanes are moving to retracted position.

8. A pump according to claim 1, wherein the side wall of the chamber, in the vicinity of the inlet and outlet, is enlarged to minimize trapping of fluid by the vanes during operation of the pump.

* * * * *